United States Patent [19]

Williams et al.

[11] 3,964,417

[45] June 22, 1976

[54] WATER VEHICLES

[75] Inventors: Marshall L. Williams, Santa Monica; William P. Peschel, Venice, both of Calif.

[73] Assignee: Hydrobike Incorporated, Venice, Calif.

[22] Filed: Aug. 22, 1975

[21] Appl. No.: 606,768

Related U.S. Application Data

[63] Continuation of Ser. No. 469,633, May 14, 1974, abandoned, which is a continuation of Ser. No. 305,302, Nov. 10, 1972, abandoned.

[52] U.S. Cl. ..... 114/66.5 H; 115/70

[51] Int. Cl.[2] ..... B63B 1/20

[58] Field of Search ..... 114/66.5 H, 66.5 R; 115/6.1, 70

[56] References Cited

UNITED STATES PATENTS

| | | | |
|---|---|---|---|
| 3,081,728 | 3/1963 | Wilterdink et al. | 114/66.5 H |
| 3,294,055 | 12/1966 | McGuire | 115/70 |
| 3,552,349 | 1/1971 | Snow | 114/66.5 R X |
| 3,703,877 | 11/1972 | Ueda | 115/70 |

*Primary Examiner*—Trygve M. Blix
*Assistant Examiner*—Barry L. Kelmachter

[57] ABSTRACT

A water vehicle particularly suited for recreational use and designed to simulate the control and excitement of motorcycles, dune buggies and the like. These water vehicles are characterized as having a forward planing surface and rear hydrofoil members disposed so as to support the majority of the weight of the vehicle and passengers when operating at high speed. Sufficient lateral buoyancy is provided for flotation and low speed operation by a pair of spaced apart float assemblies toward the rear of the vehicle. The winglike members between the float assemblies and the vehicle body and the other hydrodynamic surfaces are designed to allow transition from low speed to high speed operation with a minimum of propulsive power required. Power may be provided by conventional outboard motors of a reasonable range of sizes, with stable but responsive control during high speed operation being provided by a combination of the steering apparatus and the spacing and support capability of the hydrofoils. One embodiment dispenses with the hydrofoils and utilizes the planing characterists of the flotation assemblies.

26 Claims, 22 Drawing Figures

5-5
20
22
24
26
28
30
32
34
36
38
40
42
44
46
48
60
66
80
82
84
86
87
88
89
92
CG
150
152
154

Fig. 15
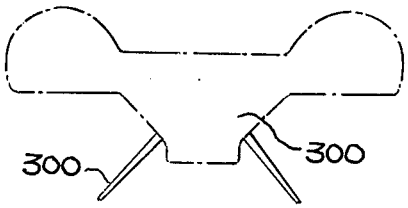
Fig. 16
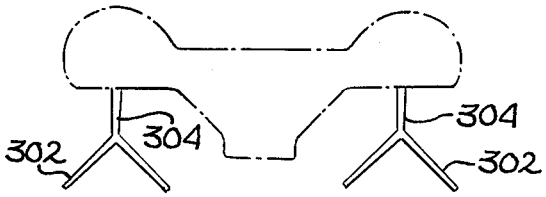
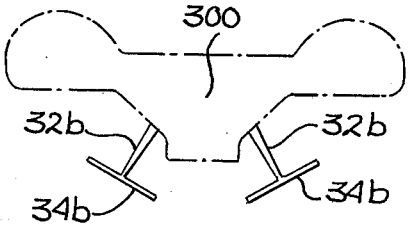
Fig. 17
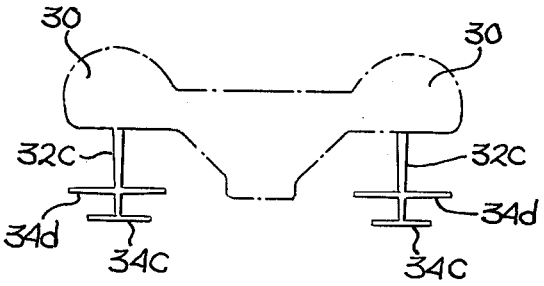
Fig. 18
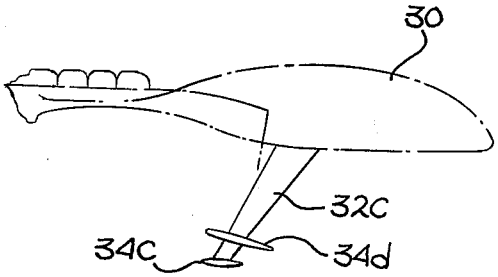
Fig. 19
Fig. 20
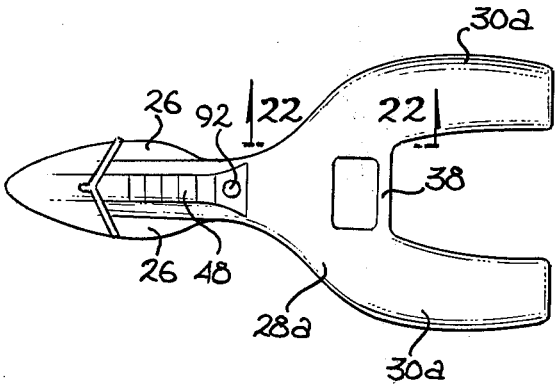
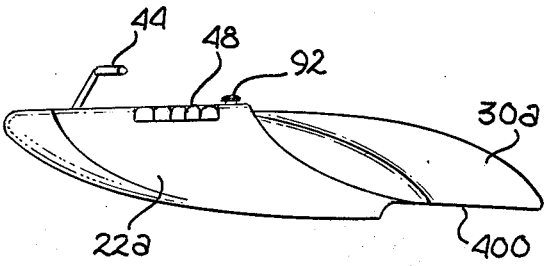
Fig. 21
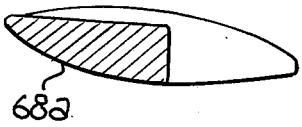
Fig. 22

WATER VEHICLES

This is a continuation of application Ser. No. 469,633, filed May 14, 1974, now abandoned, which is a continuation of application Ser. No. 305,302, filed Nov. 10, 1972, now abandoned.

BACKGROUND OF THE INVENTION

1. Field of the Invention

The present invention relates to the field of water vehicles, and particularly water vehicles of the hydrofoil type.

2. Prior Art

Water vehicles of a wide variety of configurations are well known in the prior art. Of particular importance to the present invention are water vehicles of relatively small size designed to operate on the surface of the water, and to be supported thereby during the higher speed operation thereof, not by the displacement of a substantially equal mass of water, but instead by the hydrodynamic forces on the hull (typically referred to as planing) and/or through the use of hydrofoils piercing and operating below the surface of the water. Planing type hulls of course are well known, though in recent years various new configurations for such hulls have been produced in substantial quantities. Typically such hulls are characterized by a v-shaped, curved forward section for slicing into the water as required, with the v becoming shallower and shallower, sometimes significantly approaching a flat bottom towards the stern for sliding over the surface of the water. Therefore, the forward section of the hull is designed to gradually engage the water, whereas the center and particularly the rearward portion of the hull is designed to be supported by the water through relatively low hydrodynamic pressures distributed over the area. Thus, planning may be achieved at a reasonably low speed. However, such hulls are characterized by a very large wetted area and therefore relatively high and steadily increasing viscous drag occurs with higher speed operation. The newer configurations for such hulls include hulls that approach twin and triple hull configurations, both of which operate however in a similar manner.

Hydrofoils, on the other hand, may be characterized as water piercing supporting members in which the support is derived not only from the increased hydrodynamic pressure on the bottom surface of the hydrofoil, but also from the decreased dynamic pressure of the water flowing over the top surface of the hydrofoil. Thus the hydrofoil is much like the wing of an airplane, and effectively "flies" at a controlled position beneath the surface of the water.

The similarities between hydrofoils as they operate in water and airfoils as used for wings etc., of airplanes are substantial. While air is a compressible medium, negligible compression occurs while flying at speeds well below the speed of sound so that the air essentially behaves as it it were incompressible. As in an aircraft, dynamic stability of a water vehicle is a most important consideration, for the vehicle must operate not only in "static" equilibrium but must survive and return to the static condition when perturbed by wave motion, shifts in weight of the vehicle, etc. and underwater disturbances. In this regard, stability about the yaw axis and about the roll axis of a water vehicle may be achieved in much the same manner as it is achieved for an airplane, that is, stability about the yaw axis by a significant rudder type surface behind the center of gravity of the vehicle, and about the roll axis, either as a result of the dihedral of the hydrofoils etc., or specifically in the water vehicle situation by the reduced lift of a hydrofoil as it approaches or pierces the surface of the water. However, for a water vehicle using hydrofoils, the problems about the pitch axis are particularly severe for a number of reasons. Some of these problems include the fact that the hydrofoils, by necessity, are not located vertically near the center of gravity of the vehicle, since a very large percentage of the total mass of the vehicle is supported by hydrofoils above the water, whereas the hydrofoils must extend below the surface of the water by a proper amount. Thus, changes in drag on the hydrofoils due to changes in proximity of the hydrofoil to the water surface, turbulence in the water, etc., result in a substantial pitching moment on the vehicle. In this regard it should be noted that, particularly with smaller vehicles in large bodies of water having substantial wave motion, ground swells, etc., it is quite necessary that the depth of penetration of the hyrofoils be reasonably controlled so that the vehicle may generally follow the wave contour, as opposed to ploughing into the face of the wave. (In larger vehicles control is also required, though generally not with respect to wave motion since such vehicles generally are supported above the surface of the water by the hyrofoils by an amount equal to or greater than normal wave action).

Another factor or problem encountered, which is unique to the hydrofoil situation in comparision to airfoils on airplanes, is that there is a very sharp discontinuity in the density and other characteristics of the medium near the desired operating position of the hydrofoil, e.g. the air-water interface at the surface of the water. Thus, the depth of penetration of the hydrofoil must be carefully controlled if it is to operate as a hydrofoil and not attempt to rise to the surface of the water to merely operate as a small planing surface. Consequently, in the prior art, even with large hydrofoil vehicles, a control system has been used to essentially control the angle of attack of the hydrofoils to provide the required stability, and to control the depth of penetration of the hydrofoils for most optimum operation thereof.

Hydrofoil control systems for larger vehicles, while being relatively expensive, provide the desired result and are economically justifiable because of the improved speed, etc., of the vehicle over a more conventional hull type. However, since a certain amount of mechanism is required to provide hydrofoil control responsive to the proper operating parameters, and often for small vehicles even greater control is required since smaller vehicles must generally follow smaller, more frequent disturbances, the cost of the control system is not decreased in proportion to other decreases in cost for smaller vehicle. Consequently, while many hydrofoil configurations have been proposed for use in small recreational vehicles, there is at the present time no commercially successful small hydrofoil vehicle for recreational purposes adapted to carry a single individual or a small number of passengers. Thus, while there has been a proliferation of various types of off-the-road land vehicles for recreational purposes, such as trail bikes, dune buggies, etc., there has not been a proliferation of recreational vehicles of a similar character for water use, primarily because of the lack of efficient and practical design for high performance, small water vehicles. This has been true even though there are presently in this country hundreds of thousands of outboard motors suitable for propelling such vehicles, whereas each land vehicle typically requires as a part thereof a special limited purpose and permanently installed engine. Thus, there is a need for water vehicles of the recreational type to duplicate, on water, the speed, stability, performance and excitement achieved with motorcycles and dune buggies on land, which are capable of highly responsive yet safe performance, and which preferably utilize conventional outboard engines of a reasonable range of power so as to minimize the cost of such vehicles for persons already owning or having access to such an outboard engine.

BRIEF SUMMARY OF THE INVENTION

Water vehicles particularly suited for recreational use and designed to simulate the control and excitement of motorcycles, dune buggies and the like. Water vehicles which are characterized as having a forward planing surface and rear hydrofoil members disposed so as to support the majority of the weight of the vehicle and passengers when operating at high speed. Specifically, in the preferred embodiment the hydrofoils are disposed so as to support approximately 75 percent of the weight of the vehicle including engine, fuel, riders, etc. Sufficient lateral buoyancy is provided for flotation and low speed operation by spaced apart float assemblies toward the rear of the vehicle. The wing-like members between the float assembly and the vehicle body and the other hydrodynamic surfaces are designed to allow transition from low speed to high speed operation with a minimum of propulsive power required. Specifically, the leading edge of the wing-like members is normally disposed above the surface of the water when the vehicle is at rest, with the lower surface of the wing-like members forming an incline to encourage the vehicle to come up on a plane with a minimum of power. Power may be provided by conventional outboard motors of a reasonable range of sizes, with stable but responsive control during high speed operation being provided by a combination of the steering means and the spacing and support capability of the hydrofoils. Inboard-outboard engines and water jets, by way of example, are also possible means of power as are multiple outboard engines. Alternate embodiments include members attached to the lower aft portion of the float assemblies to either increase the planing area thereof or to increase the lift thereof. A manual control system for either of these embodiments is disclosed. Also disclosed are a pair of central hull mounted spoilers for foot control to aid in steering or braking of the vehicles.

BRIEF DESCRIPTION OF THE DRAWINGS

FIG. 15 is a view similar to FIGS. 6 through 9 illustrating an alternate hydrofoil configuration.

FIG. 16 is a view similar to FIG. 15 showing another hydrofoil configuration.

FIG. 17 is a view similar to FIG. 15 showing still another hydrofoil configuration.

FIG. 18 is a view similar to FIG. 15 illustrating a double hydrofoil configuration.

FIG. 19 is a side view of a portion of the vehicle shown in FIG. 18.

FIG. 20 is a top view of an alternate embodiment hydrobike which does not utilize hydrofoils.

FIG. 21 is a side view of the hydrobike of FIG. 20.

FIG. 22 is a cross-section for the hydrobike of FIG. 20 taken along lines 22—22 of that figure.

DETAILED DESCRIPTION OF THE INVENTION

Figures 1, 2, 10:
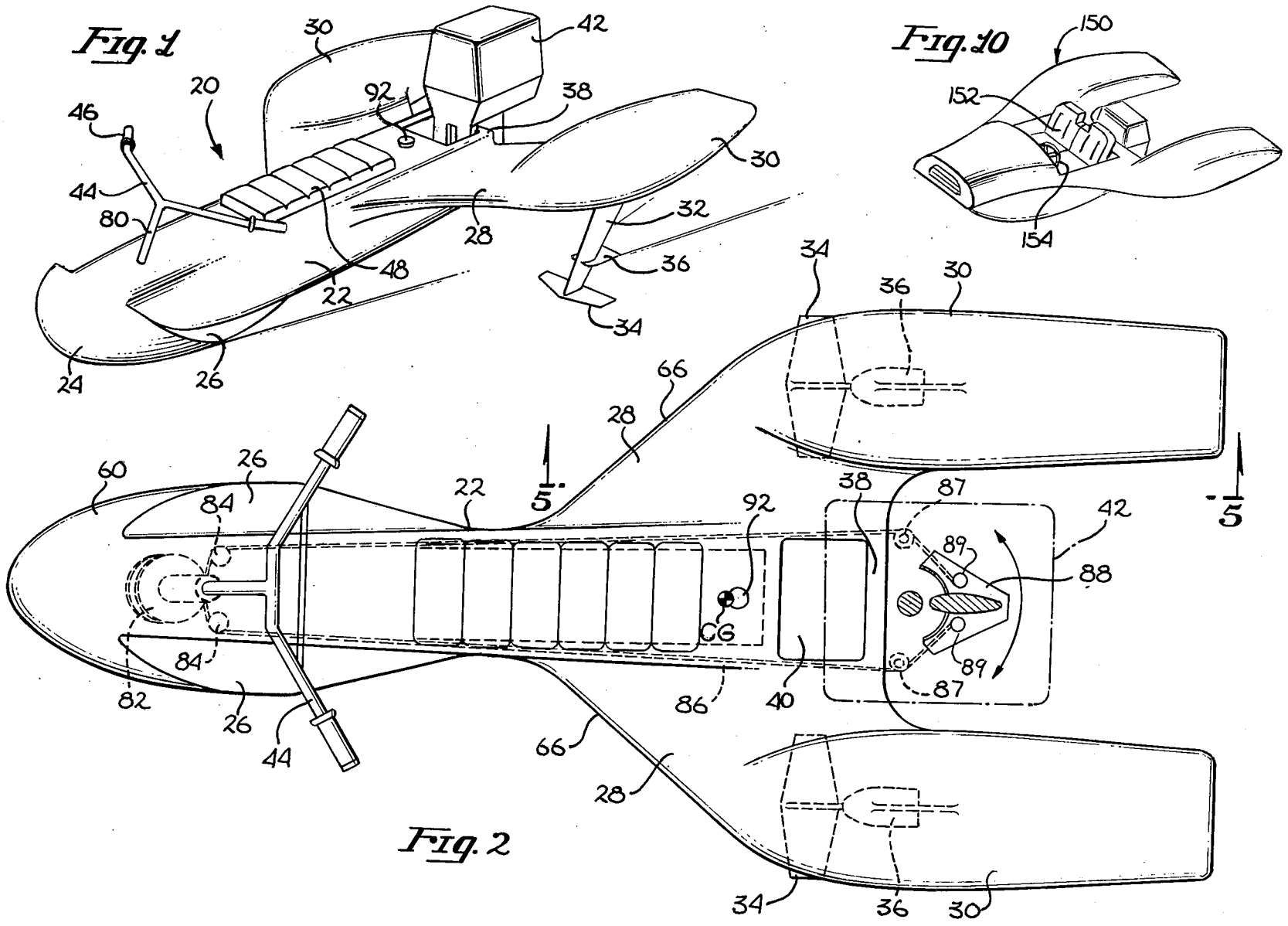
FIG. 1 is a perspective view of one embodiment of the water vehicle of the present invention referred to as a Hydrobike.
FIG. 2 is a top view of the Hydrobike of FIG. 1.
FIG. 10 is a perspective view of an alternate embodiment vehicle referred to as the Hydrobuggy.

First referring to FIG. 1, a perspective view of the preferred embodiment of the present invention may be seen. This embodiment will be referred to herein as the "Hydrobike," as it duplicates in a water vehicle many of the performance attributes of a motorcycle. The Hydrobike 20 is characterized by a central longitudinal hull region 22 having an integral forward section 24, of a greater width than the longitudinal hull 22, so as to define protected foot rests 26. Extending outward from the rear portion of the central hull 22 are a pair of swept back wing-like members 28 supporting, at the outer portion thereof, elongated outriggers 30. Each of the outriggers supports a downward, somewhat forward projecting member 32 having a horizontal hydrofoil 34 adjacent at the bottom thereof and a small planing ski surface member 36 disposed on member 32 somewhat above the hydrofoil 34.

The body section 22 terminates at the rearward portion thereof by a small transom member 38, defined in part by a motor well area 40 so that a standard outboard engine 42 may be attached by conventional means to the transom. Appropriately disposed towards the forward end of the section 22 are a set of handlebars 44 coupled by a mechanism to the motor 42 so as to provide a steering capability to the assembly by rotation of the motor in response to rotation of the handlebars 44. Also, the handlebars 44 have one handle grip 46 adapted for rotation about its axis and coupled to the throttle control of the motor. The type of throttle control is conventional for motorcycles, and the mechanisms and arrangement of components to achieve the desired purpose is well known in that prior art. It is, however, adequately spring loaded to assure the automatic return of the throttle to the idle position. In addition, a cord (now shown) connects the engine cut-off switch to the rider, so that upon his unintentional departure from the vehicle, the ignition is cut and the throttle returns to the idle position.

A padded seat 48 is provided on the top surface of the central hull 22, appropriately disposed with respect to the handlebars 44 and the foot rest area 26 so as to provide comfortable seats for persons of varying size.

The particular configuration of the hydrobike shownin shown in 1 has an especially attractive appearance. However, there is a number of particularly important structural features achieved through the design shown in FIG. 1 which may also be achieved with hydrobikes and other vehicles of different outward appearance. These functional features combine to provide the unusually high performance and versatility in the vehicles utilizing these features, whether in the form of a hydrobike shown in FIG. 1, the hydrobuggy subsequently to be described, or in still another water vehicle designs. These features combine to provide adequate flotation to the vehicle at rest in the water with an engine, a full load of fuel and a rider thereon, to provide adequate stability while at rest in the water so as to not tip over while a rider boards the vehicle, to provide reasonable low speed characteristics while maneuvering at speeds at which the vehicle behaves as a displacement vehicle, to provide transition from low speed to the planing and to the flying conditions with minimum power required, provide adequate stability, yet high maneuverability at high speeds and to provide resistance to the diving of the nose when quickly going down from high speed operation, and further to provide the desired high performance and safe operation with any engine within a relatively wide power range, which range comprises a large percentage of the outboard engines presently existing.

Figure 3:
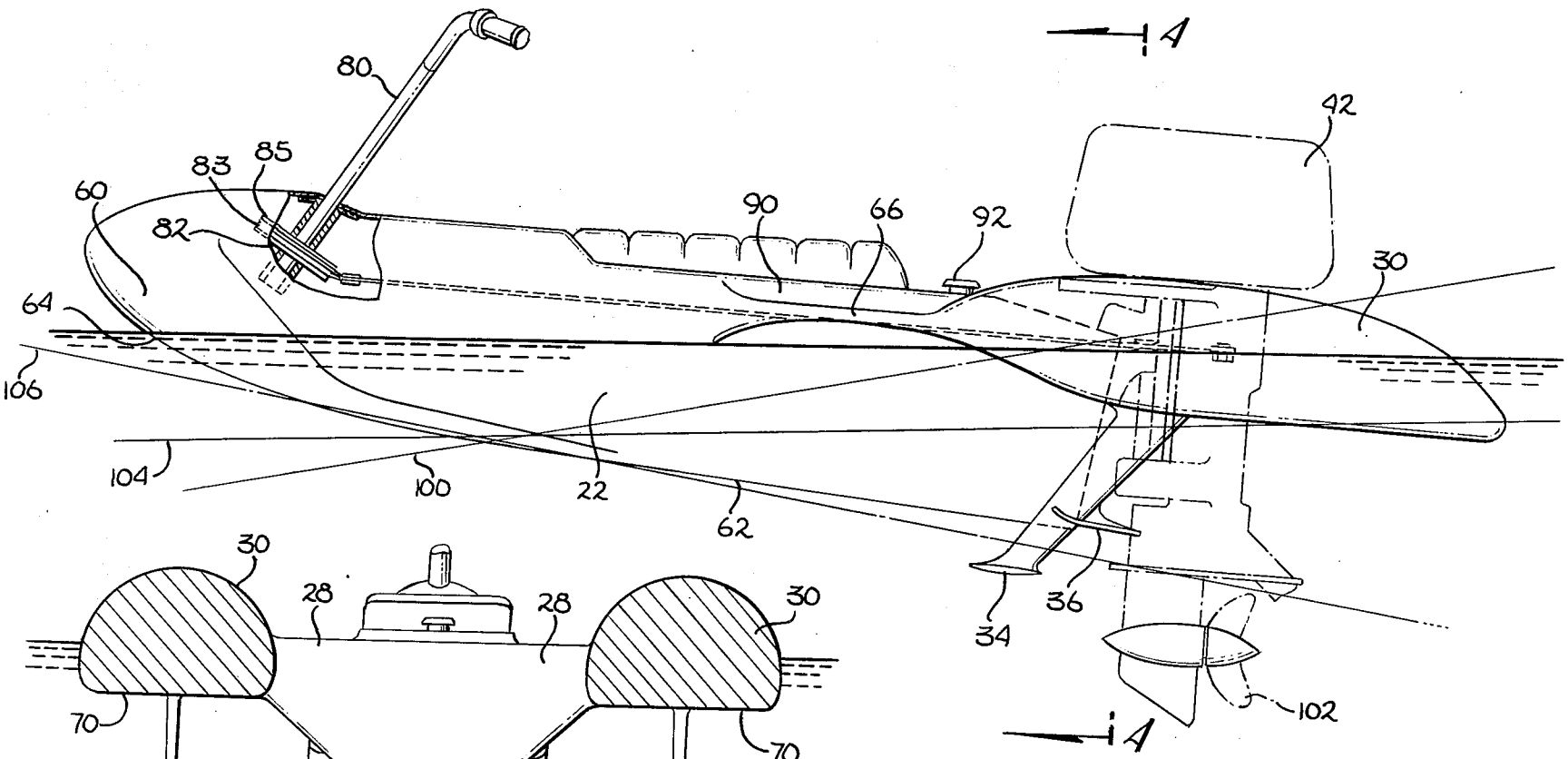
FIG. 3 is a side view of the Hydrobike of FIG. 1.

Now referring particularly to FIGS. 2 and 3, some details of the structure of the Hydrobike may be more specifically seen. The central hull 22 of the Hydrobike is substantially narrower than the forward portion thereof, particularly at the bottom surface of the hull. The widened region curves upward in region 60 toward the bow of the Hydrobike and defines conveniently disposed footrests 26 so as to shelter the operator's legs from any high energy spray or water flow passing to the side of the wider bow area. In addition, this increased width at the bow, particularly in the region 60 curving upward from the generally straight keel of the vehicle provides a rapid increase in planing surface as well as buoyant volume with increased penetration of the forward portion of the central hull 22 in the water. This is highly advantageous since is assures that the bow will achieve the planing status at a minimum speed, will ride over waves and the like without ploughing into them and will not nose in upon a rapid shut down of power, even from high speed operation.

In the preferred embodiment, the lower surface 62 of the central hull is substantially flat, as is the lower surface 64 of the forward area 60, though other shapes may also be used if desired, depending upon the particular desired characteristics of the vehicle. It has been found, however, that the flat lower surface is particularly easy to construct, provides good planing characteristics, creates a wake which does not interfere with the desired performance of the other hydrodynamic surfaces or any other modes of operation of the vehicle, and does not provide an unreasonably rough ride because of the relatively small area involved and the fact that most of the supporting force of the vehicle at high speed is provided by the hydrofoils as will subsequently be described.

Figure 5:
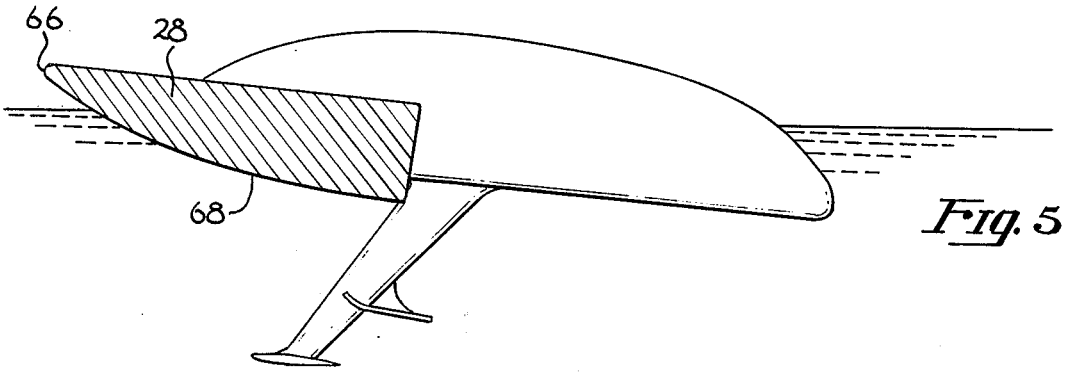
FIG. 5 is a cross-section of the Hydrobike taken along the lines of 5—5 of FIG. 2.

Approximately midway along the central hull 22, swept wing-like members 28 join the central hull and project outward to the outriggers 30, which are spaced to each side of the motor area and extend rearward a substantial amount. The wing-like areas 28, while providing the structural support for the outriggers, are themselves specifically designed for hydrodynamic characteristics. In particular, the forward edge 66 of these members should join the central hull 22 at the upper area thereof, and most specifically the forward edge 66 should normally be disposed above the surface of the water for any reasonable engine size, passenger and fuel load while the vehicle is at rest in the water. This may be specifically seen in FIG. 5, which is a cross-section taken along lines 5—5 of FIG. 2. The lower surface 68 of the wing-like member 28 in the preferred embodiment is a curved surface extending downward so as to join the central hull 22 at the rear portion of the wing-like members 28 adjacent to the lower surface of the central hull, and similarly to join the outriggers adjacent to the lower surface thereof, so that the lower surface of the wing-like members define planing surfaces. It has been found to be important that the leading edges 66 project above the surface of the water when the vehicle is fully loaded and statically at rest in the water, so that the vehicle may progress from the rest condition through the planing condition and into a flying condition with a minimum of propulsive force required at each stage of the transition. Thus, a relatively small engine will adequately propel the vehicle up to the flying condition, and the engine propeller pitch and size may be selected for high speed performance without undue concern about having sufficient force to overcome a potentially high drag condition during the transition phases. If the leading edges do not project out of the water during the static condition, it has been found that the water flow over the top surface of the wing-like member encountered at low speed detects greatly from the lifting force of the lower surface of the wing-like members, and in addition a large "bow wave" is created just ahead of the wing-like members so that the undesired flow over the top surface of these members continues, even after the vehicle begins to lift itself up out of the water for the planing, resulting in reduced lift and very high drag.

Figure 4:
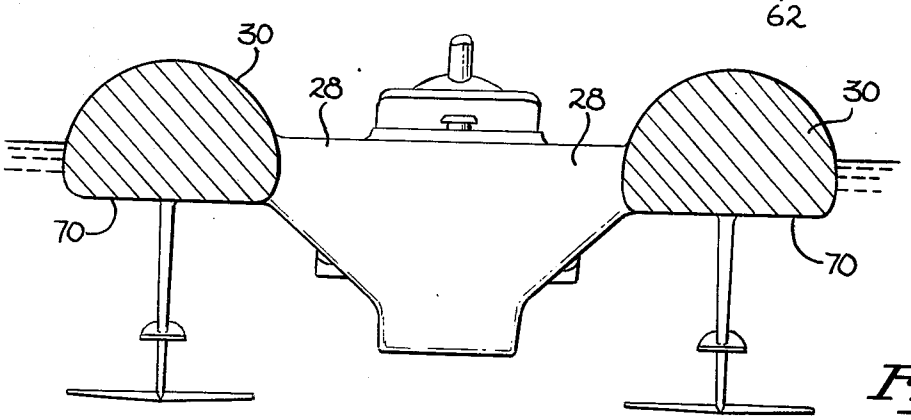
FIG. 4 is a cross-section of the Hydrobike taken along lines 4—4 of FIG. 3.

Now referring also to FIG. 4, further details of the wing-like members 28 and the outriggers 30 may be seen. This Figure is a cross-section taken along lines 4—4 of FIG. 3, and shows the generally V-shaped combination of the wing-like members and the central hull, as well as the characteristic cross-section of the outriggers. It may be seen that the lower surface 70 of the outriggers is substantially flat, and from the other figures, that the outriggers are relatively long and project significantly rearward of the position of the engine. The flat surface of the outriggers aids in the planing thereof during intermediate speed operation, and the length and relative disposition of the outriggers result in substantial buoyancy and stability of the overall system while still maintaining relatively low profile drag for these buoyant members. Attached to the outriggers are the downward projecting members 32, with hydrofoils 34 and small ski members 36 thereof, as previously described.

Steering of the vehicle is accomplished by rotationally supporting the handlebars 44 with respect to the central hull through a shaft 80. Since the engine is located behind the center of gravity, it must rotate in a direction opposite to the rotation of the handlebars. This is accomplished by utilizing a pulley 82 with two grooves 83 and 85 (FIG. 3) which is rigidly affixed to the steering shaft 80 and having steel cable 86 wrapped around the pulley. The cable is attached to the pulley and overlaps from one groove to the other therein, in order to permit the cable to cross over itself and thereby reverse the rotation direction. Idler pulleys 84 and 87 guide the steering cable in straight lines through tubes located within the central hull. Idlers 84 are attached to internal structure, while idlers 87 are attached externally to the transom 38. The linkage is completed at the motor steering bracket 88 which is clamped to the vertical structure of the motor itself. A hysteresis-free and slop-free system is provided by having a circular are available on bracket 88, which has a virtual center at the motor steering pivot. The ends of the cable 86 are wrapped around small, fixed pulleys and anchored with cable clamps at terminations 89, so that any required pre-load can be incorporated in the steering cable prior to securing the cable clamps. Since the motor moves through an angular range of about ±45° from the straight ahead position, a flexible cable is utilized to provide throttle control from the right-hand grip on the handlebars (operation is exactly the same as on a motorcycle).

Thus, it may be seen from the foregoing description that the primary structure of the hydrobike consists of a center hull incorporating a seat, handlebars controlling throttle setting and steering, a transom for outboard motor attachment and an inner fuel tank. The shape of the forward section is extremely important, providing two necessary features. First the underside comprises a flat planing surface upswept at the forward end and approximately thereat a diamond shape in plan form. Second, the hull behind the nose and above the planing surface is considerably narrowed, thereby providing a footrest and splash guard for the rider's feet. Aft of the planing section, wings attach a pair of outriggers to the center hull. Here again the shape is extremely important. The wind leading edge is located near the top of the structure, extending laterally to the outriggers in a straight, swept-back line to form a delta plan form. The underside of the wing gradually changes the hull cross-section from rectangular at the midpoint to approximately V bottomed at the rear. The outriggers are flat on the bottom surfaces, extending aft to a point somewhat behind the motor. Finally, hydrofoils are attached to struts protruding from the underside to the outriggers on each side of the vehicle. The hydrofoils are positioned with rspect to the center of gravity of the vehicle, including the rider, so that when the aft portion of the vehicle is supported by the hydrofoils during high speed operation, the foils are supporting approximately 75 percent of the total weight of the vehicle and rider. The nose section is designed to prevent diving during a rapid shut down from high speed, and the outriggers are proportioned to provide sufficient buoyancy to prevent overturning while the vehicle is being boarded or while leaning to the side during static or low speed operation.

The two hydrofoils which support approximately 75 percent of the total weight during high speed operation are positioned shortly aft of the center of gravity. The foil in the preferred embodiment is a tapered wing and has an aspect ratio of four to one. The foil cross-section may be either a simple circular arc, or one of the more sophisticated NASA air foil shapes suitable for high speed underwater operation without cavitation. Each foil is located approximately one to one-half mean cord lengths below the water surface at the high speed condition. This choice of depth location aids in the automatic regulation of the aft hull vertical position with respect to the water surface by utilizing the socalled "surface effect" of hydrofoil lift performance. Above each foil is a small ski incorporating a slightly upswept leading edge and having a flat lower surface. These skis are vertically positioned so as to be disposed slightly above the water surface during the speed operation (specifically the condition referred to as "flying"). The skis serve the purpose of providing enough planing lift to compensate for any loss of foil lift due to underwater perturbations and hence automatically maintain the vehicle in lateral stability during high speed operation. The surface area of each ski is small enough to permit the rider to intentionally tilt the vehicle by leaning to the side in order to negotiate a coordinated turn. In addition, the small area contributes but little underwater drag during submerged operation at intermediate or low speeds. The forward sweeping foil strut is functional, as well as esthetically appealing, in that surface disturbances caused by the strut and ski cannot propogate an air passage to the upper contour of the submerged hydrofoil during operation (a detrimental condition termed "ventilation" which causes significant loss of foil lift, since the pressure on the upper surface of the hydrofoil is significantly less than atmospheric pressure). When the forward leaning strut, all disturbances are behind the foil so that any incipient air passage cannot impinge on the foil, because to do so would require that it move upstream against the water flow direction. The lateral location of the foils and strut is also an important parameter as it must be positioned and arranged such that any wake having separated or turbulent flow does not reduce the propeller efficiency, which would result in propeller thrust loss and thereby effect maximum speed performance. On the other hand, they should also not be separated to such an extent as to provide excessive resistance to the tilting and manual control of the vehicle to negotiate coordinated turns and the like.

The forward planing surface of the central hull supports about one-fourth of the total vehicle weight during high speed operation, and because of its position both ahead of the center of gravity and upon the water surface it provides automatic longitudinal stability to the hydrofoils, which are located behind the center of gravity. Whenever lift changes due to disturbances in the water, etc. the foils either move move upward or downward, depending upon whether the angle of attack is increased or decreased by the disturbance. Since the forward planing surface is always on top of the water, ahead of the center of gravity, the following control automatically occurs as a perturbation arises: if the foils tend to sink, the entire vehicle rotates about the forward planing surface, since that surface at high speed may not significantly penetrate the water surface. As this happens, the angle of attack of the foils is increased, and therefore the lift increases, which then offsets the loss in lift caused by the perturbation. If the foils tend to rise, the vehicle again rotates about the planing surface and this adjustment results in a decrease of foil angle of attack, and also places the foil closer to the surface where the surface effect comes into play. Both of these last conditions reduce lift and therefore offset the increased lift caused by the perturbation. In practice, unless a perturbation is extremely large, the automatic longitudinal control realized by this unique combination of planing foward surface and aft hydrofoils results in a smoothe ride, exhibiting less slapping and porpoising than a conventional small boat traveling at the same speed. In this regard it should be noted that while the nose is generally adapted so as to not significantly penetrate the surface of the water at high speed, the smoothness of the ride as experienced by the rider is determined principally by the smoothness of the hydrofoil support since the rider is supported primarily by the hydrofoils. Of course, other nose shapes may also be used, including a more conventional V-shaped nose, through it has been found that the specific configuration disclosed herein provides a very high performance vehicle.

Now referring again to FIG. 3, the modes of operation for the hydrobike may be explained. Of course at rest, the hydrobike floats in a position determined by the total weight of the vehicle. In this regard, it should be noted that the center of gravity of the vehicle is only slightly forward of the hydrofoils so that to avoid floating in an excessively nose high orientation, the outriggers 30 extend relatively well behind the motor position, and particularly well behind the position of the hydrofoils.

During low speed operation, referring to herein as taxiing, the hydrobike operates in a relatively nose high position, as indicated by the line of reference 100 in FIG. 3, indicating the relative water surface position in this mode. It is to be noted that the nose of the hydrobike is relatively light and further, that the propeller 102 of the engine 42 is necessarily located substantially below the center of gravity of the vehicle. Thus, with the rapid advance of the throttle when in the taxiing position, a very high nose orientation similar to motorcycle "wheelies" is achieved. This condition may also be brought about by advancing the throttle somewhat and simultaneously shifting the body weight aft while pulling back on the handlebars. Very short radius turns may be achieved in either the normal taxiing phase or while doing "wheelies" as described herein. Of course, here again the length of the outriggers 30 play an important part. If they are too short the vehicle could inadvertently flip over, or if they are unreasonably long, wheelies and the associated maneuverability would be limited.

As speed increases, the planing effect of the wing-like members and outrigger surfaces raise the rear portion of the hydrobike, and as speed is further increased the hydrobike comes up to a full planing condition, riding primarily on the central hull 22, with the relative water surface being indicated by line 104 in FIG. 3. In this condition, the lower portion of the outriggers is on top of the water surface at all times. The speed range at this condition is approximately 15 to 25 miles per hour, and small radius turns can easily be achieved by coordinating steering and leaning as on a motorcycle.

If the transition from rest or taxiing to planing is achieved by a rapid throttle increase, a large acceleration results, which propels the vehicle forward and upward from the taxiing position until the entire hull is out of the water. Considerable skill is needed to master this rocket take-off, especially when descending back to the water surface as the acceleration decreases.

When in the planing condition, the hydrofoils 34 are providing a substantial amount of lift, depending upon the exact planing speed, and the small skis 36 are also generally providing some lift. However, the drag in this condition is relatively low, and a reasonable size engine may steadily increase the speed, thereby increasing the amount of lift provided by the hydrofoils 34. In general, the angle of attack of the hydrofoils is set so that as speed increases the hydrofoils eventually are capable of supporting all of the weight on that part of the vehicle, and consequently lift not only skis 36 but also the aft portion of the bottom of the central hull 22 off the surface of the water, so that the hydrobike is supported by the planing action of the forward part of the central hull and by the hydrofoils 34. This condition is referred to as "flying" with the relative water surface position being shown as line 106 in FIG. 3. Further increases in speed may somewhat increase the elevation of the rear portion of the vehicle, though this decreases the angle of attack and the lift characteristics of hydrofoils because of the surface effect, thereby preventing the hydrofoils from raising to a planing condition. It may therefore be seen that at moderate speeds that the entire underbody of the central hull 22 acts as a planing surface, but as speed is further increased the rear portion of the vehicle is held above the water surface by the action of the hydrofoils. Thus, the wetted surface of the hull is greatly reduced in this condition, thereby reducing viscous drag and further, the pounding of a planing hull which would normally be encountered under such conditions is eliminated, thereby providing a much smoother ride by the somewhat softer support of the hydrofoils.

There has been described hereinbefore the design and operation of one embodiment of the present invention. This embodiment is preferred because of its structural simplicity, visual appearance, adequate buoyancy, suitability for operation with most common outboard engines manufactured, and relatively low cost of manufacturing. Other embodiments, using the same principles may readily be designed however, to carry more passengers or to achieve somewhat different operating characteristics. By way of example, a prospective view of a two passenger vehicle similar to a dune may be seen in FIG. 10. This vehicle, referred to as a "Hydrobuggy," is very similar to the Hydrobike in general configuration, having a wider hull area 150 to accommodate a seat area 152 for two passengers. The handlebars of the hydrobike are replaced by a steering wheel 154, which may be used to control a single or a twin outboard arrangement for steering. Of course, such a vehicle, as well as the hydrobike, may be designed to use an inboard power plant such as by way of example the now well known inboard-outboard systems or the water jet systems. Of course, any such systems must be adapted so that the propelling means (or water intake for the water jet) is properly disposed below the surface of the water when the vehicle is flying. In other respects the hydrobuggy is very similar to the hydrobike, being changed only in size and somewhat in proportion, in accordance with the principles herein before described in detail, to achieve the dune buggy equivalent in a water vehicle.

Figure 6:
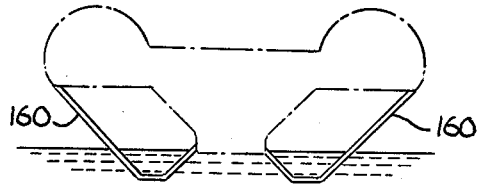
FIG. 6 is a view of an alternate form of the Hydrofoil with a cross-section of the hydrobike similar to that of FIG. 4 shown in Phantom.

Other hydrofoil members may also be used with either the hydrobike or hydrobuggy, as shown in FIGS. 6 through 9. These figures are cross sections of a hydrobike similar to FIG. 4, with the hydrobike itself being shown in phantom. In FIG. 6 the hydrofoil 160 is a member having the desired hydrofoil section, appropriately bent in the general V shape shown in FIG. 6 with the inwardly directed shorter legs of the V shape attached to the central hull and the outer portion attached to the outer extremity of each outrigger. Such a hydrofoil is referred to as a surface piercing hydrofoil, and as compared to the previously described hydrofoil, provides a further increase in lift when the rear of the vehicle settles lower in the water because of the fact that there is increased hydrofoil surface area in the water under that condition. This hydrofoil shape also may have certain structural advantages, depending upon the particular vehicle, since it is automatically rigid as to torsional and side forces.

Figure 7:
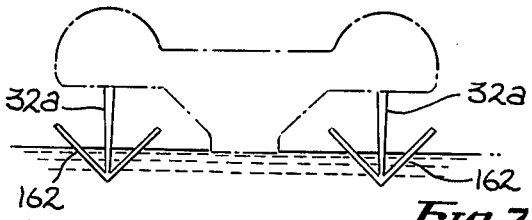
FIG. 7 is a view similar to FIG. 6 showing a further alternate Hydrofoil.
Figure 8:
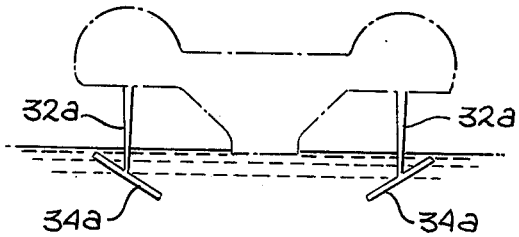
FIG. 8 is a view similar to FIG. 6 showing a still further alternate embodiment Hydrofoil.

FIG. 7 shows another type of surface piercing hydrofoil. This hydrofoil would be located on forward extending members 32(*a*) similar to members 32 shown in FIG. 1, with the hydrofoils 162 being bent upward as compared to the hydrofoils 34 so as to pierce the surface of the water. The net result is similar to that achieved with the hydrofoils of FIG. 6, but with the hydrofoils being supported in a different manner. FIG. 8, on the other hand, shows a hydrofoil supported by similar downward and forward projecting members 32(*a*), but with the hydrofoils 34(*a*) similar to hydrofoil 34 shown in FIG. 1 being canted. Such a configuration may or may not be surface piercing, depending upon the relative proportions used, but in any event has the advantage that side slip experienced by the rear of the vehicle will tend to lower the angle of attack on the inner hydrofoil and raise the angle of attack on the outer hydrofoil so as to create the desirable effect of automatic leaning of the vehicle into the turn.

Figure 9:
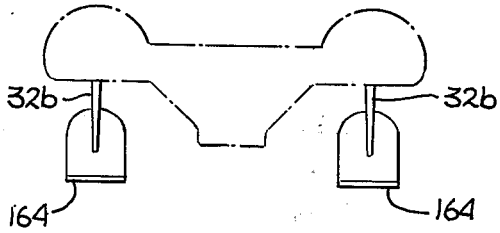
FIG. 9 is a view similar to FIG. 6 showing the use of water ski like members in place of the Hydrofoils of FIG. 1.

FIG. 9 shows a further embodiment having a ski 164 similar to a water ski attached to the ski support member 32(*b*), again similar to the support 32 shown in FIG. 1. In the flying condition the ski, of course, progresses along the surface of the water. Such an embodiment tends to provide a rougher ride than the hydrofoil configuration and tends to have somewhat higher drag before reaching the flying condition, though the rough ride may be minimized by utilizing a somewhat flexible ski and, if desired, a somewhat flexible support.

FIGS. 15 through 19 illustrate still further alternate forms of hydrofoil. In particular, FIGS. 15 and 16 illustrate two additional embodiments of surface piercing hydrofoils. In FIG. 15, the surface piercing hydrofoils 300 extend generally outward and downward from the aft section of the central hull 300. Such a configuration makes attachment of the hydrofoils to the vehicle easier and more rigid. Furthermore, vehicles having this type of hydrofoil have been found to have improved turning characteristics over other forms of hydrofoils theretofore described. The hydrofoils 302 supported on struts 304 as shown in FIG. 16 are generally similar to those shown in FIG. 7, but with the foils canted downward instead of upward. In FIG. 17, the foil members 34*b* are similar in function and disposition to the foils 34*h* in FIG. 8, with the struts 32*b* being inclined inward and being attached to the aft portion of the central hull 300, again having certain structural advantages with respect to the ease of attachment of the hydrofoils supporting struts.

In FIGS. 18 and 19, a unique hydrofoil configuration is shown. In particular, the general arrangement of the vehicle is that of the hydrobike as in the previous figures (except for FIG. 10). A generally downward and forward extending hydrofoil strut 32*c* is mounted on each of the flotation assemblies 30 in the same manner as struts 32 mount to the flotation assemblies 30 in the hydrobike of FIG. 1. Similarly, there is a hydrofoil 34*c* on each of the struts, the hydrofoil 34*c* again being substantially the same as the hydrofoil 34 shown in FIG. 1. Mounted above the hydrofoil 34*c* is a second larger hydrofoil 34*d*. This hydrofoil, aside from being larger than hydrofoil 34*c*, is set at an increased angle of attack, so as to have a potentially higher lift than hydrofoil 34*c*, both because of its larger area and its greater angle of attack. Consequently, at higher speeds, hydrofoil 34*c* may provide the total support for the aft portion of the vehicle as in the hydrobike of FIG. 1, though at lower speeds Hydrofoil 34*d* will become operative. Also, and more importantly, hydrofoil 34*d* will become operative by its engagement into the water whenever there is a need for increased lift on a particular hydrofoil assembly, such as when a turn or other maneuvers are being executed, when waves are being jumped, etc. This allows some resilience in the hydro-dynamic support of hydrofoil 34*c*, yet stiffens up the support when needed for the more extreme conditions by an amount far greater than the normal increase in lift merely because of an increase in angle of attack of the hydrofoil 34*c* when the aft portion of the vehicle is somewhat depressed. As a result, the vehicle is given improved maneuvering and rough condition capability without degradation of the high speed performance under smoother conditions.

Figure 11:
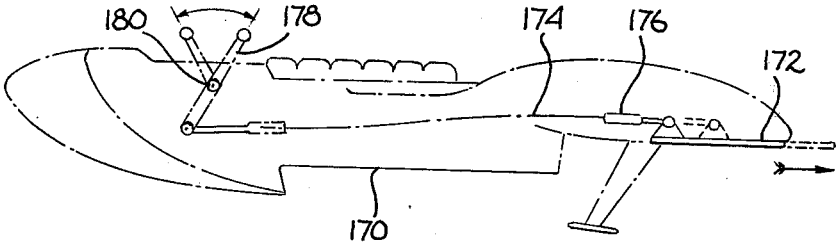
FIG. 11 is a side view of an alternate form of the Hydrobike, also incorporating a lift control means for the flotation assemblies.
Figure 12:
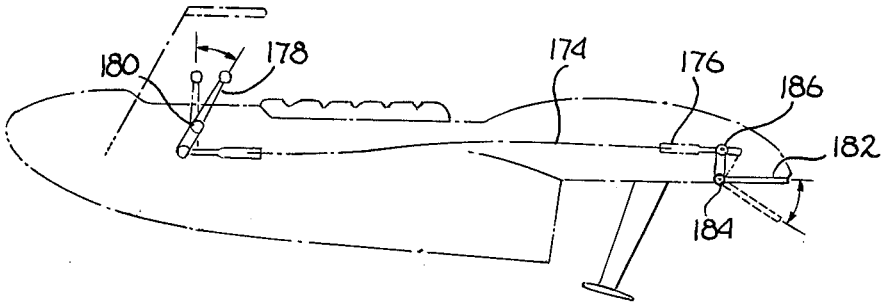
FIG. 12 is a side view of the Hydrobike illustrating an alternative form of lift control means for the float assemblies.

The preferred embodiment provides the desirable characteristic of good high speed performance with minimum power being required to go through the transitional speed ranges. Other embodiments, however, may be designed for better high speed performance at the expense of lower speed drag, or to improve performance during taxiing and in the transition to the planing condition. By way of example, in FIG. 11 there is shown a side view of a hydrobike with two modifications over the previously described embodiment. Specifically, the lower portion 170 for the central hull has been relieved so that in the planing and particularly in the flying condition, the wetted area of the planing surface is assured to be minimum, and greater penetration of the hydrofoils into the water on turns, wave perturbations, etc. is allowable without the central hull "touching down" on the surface of the water. Thus, the performance in the flying condition is improved, though greater power is required to achieve and pass through the planing condition. Also shown in FIG. 11 is an arrangement for increasing the lower surface area of the outriggers, as well as extending the center of that area rearward so as to improve performance during taxiing in the transition to the planing condition. Thus, on each outrigger there is a sliding plate 172, which is connected by a stainless steel cable 174 sliding within a plastic guide 176 to a control lever 178 pivotally supported on an axis 180 so as to be controllable by the operator to extend and retract the plates 172. As an alternate to this, as shown in FIG. 12, a plate 182 may be pivotally supported on an axis 184 on each outrigger, and controlled through a lever arm 186 by cable 174 and control lever 178, as described with respect to FIG. 11. Thus, instead of increasing the area and shifting the center of area of the outrigger. rearwardly, the plates 182 are deflected so as to merely increase the lift of the outriggers, which tends to raise the rear of the vehicle during taxiing and transition to planing.

Figure 13:
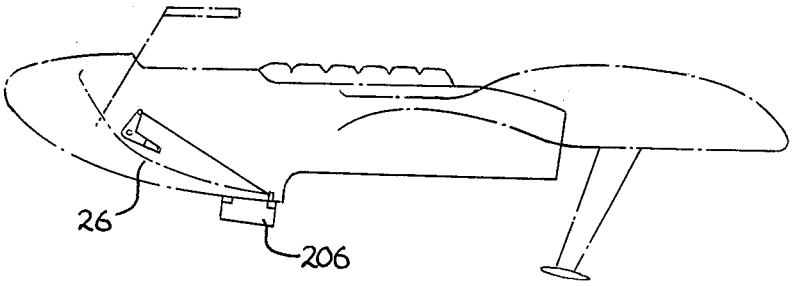
FIG. 13 is a side view of the Hydrobike having foot operated steering and braking means.
Figure 14:
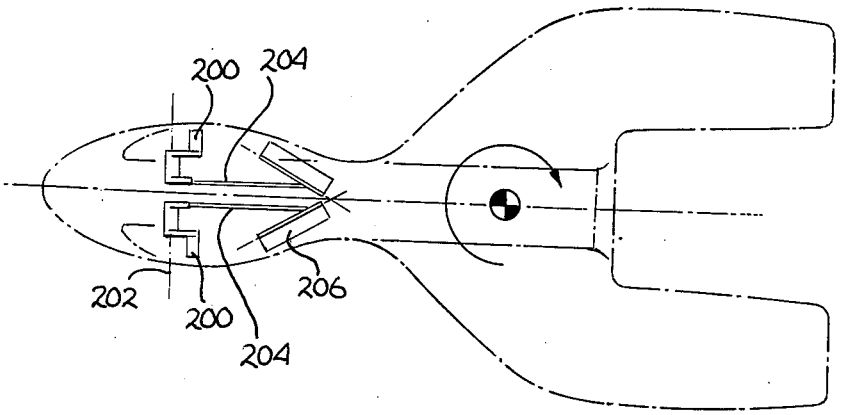
FIG. 14 is a top view of the Hydrobike of FIG. 13.

One further alternate embodiment is shown in FIGS. 13 and 14. In this embodiment, a pair of foot pedals 200 are rotationally supported on an axis 202, and spring loaded to the upper position. The foot pedals 200 are conveniently disposed above the foot rests 26 of the hydrobike, so as to be readily operable by the rider. Control rods 204 each connect one of the foot pedals to a respective one of spoilers 206, which are rotationally supported on the bottom of the forward hull and inclined with respect to the center line of the vehicle as shown. In FIG. 14, the right foot pedal has been depressed, and as a consequence, the right spoiler is rotated downward so as to form a small keel-like member inclined with respect to the central axis of the vehicle. The spoilers 206 are located forward of the center of gravity of the vehicle and therefore aid in the execution of the turn by providing a side force on the bow. By depressing both foot pedals equally there is no side force or steering force on the vehicle, but instead a braking force is achieved.

Now referring to FIGS. 20, 21 and 22, one final embodiment of the present invention may be seen. This embodiment is very similar in form and details to that of the embodiment shown in FIG. 1. Thus, there is provided the footrests 26, the steering and control apparatus through the handlebars 44, a seat 48, a transom means 38, etc. and a pair of flotation assemblies 30*a*. However, this embodiment does not utilize any form of hydrofoil or ski means, but instead the flotation assemblies 30*a* and the winglike areas 28*a* are disposed in a somewhat lower relationship to the central hull 22*a*, so that the lower surface 400 of the flotation members 30*a* is adjacent the lower surface of the center hull, and together with the central hull, form planing surfaces having a reasonably minimized area for high speed operation, with the increased area of the winglike members aiding in reducing the drag during transition to planing. Thus, in FIG. 22 the lower surface 68*a* of the winglike members 28*a* forms a planing surface having a forward portion thereof extending upward to a position adjacent the upper portion of the central hull, and a rearward portion curving downward to a position adjacent the lower surface of the central hull. This version, though having a somewhat lower performance that the hydrofoil configuration, is also lower in cost, and still provides performance exceeding presently known vehicles.

It is apparent from the above that various variations in specific details and proportions of the vehicles, as well as ornamental and functional appointments may be made as desired to provide both a customizing capability for the vehicle as well as maximization of the desired performance characteristic for a particular engine or engines to be used therewith. Thus, the vehicles have the capability of readily being "personalized," as are motorcycles and dune buggies. In the preferred embodiment, approximately 75 percent of the total weight for the vehicle (including rider, fuel, etc.) is supported by the hydrofoils. While this percentage may be reduced to say 50 percent of the weight, smoothness of the ride and other characteristics are sacrificed unless at least 60 percent of the weight is supported by the hydrofoils. On the other hand, unless at least 15 percent of the weight is supported by the bow of the vehicle (e.g. 85 percent or less by the hydrofoils) the bow tends to bounce and porpoise in an undesirable manner, depending upon the shape of the lower surface thereof.

Thus, while the invention has been particularly shown and described with reference to preferred environments for hydrobikes and hydrobuggies, it will be understood by those skilled in the art that various changes in form and details may be made therein without departing from the spirit and scope of the invention.

We claim:

1. A water vehicle comprising:

a hull member having a means for receiving at least one person to be transported, said hull member providing substantial flotation when said vehicle is at rest in the water;

planing surface means forward of the center of gravity of said vehicle, said planing surface means being the primary support for said vehicle forward of said center of gravity when said vehicle is propelled over the water at a suitably high speed; and hydrofoil means disposed at a lower elevation than said hull member and at longitudinal position aft of the center of gravity of said vehicle, said hydrofoil means being the primary support for said vehicle aft of said center of gravity when said vehicle is propelled over the water at a suitably high speed.

2. The water vehicle of claim 1 wherein said hydrofoil means and said planing surface means are longitudinally disposed with respect to the center of gravity of said water vehicle so that with suitable propelling means and normal fuel and passenger load at least approximately 60 percent but less than approximately 85 percent of the entire weight of said vehicle, propelling means and fuel and passengers are supportable by said hydrofoil means when said vehicle is being supported primarily on said hydrofoil means and said planing surface means.

3. The water vehicle of claim 1 wherein said hull member includes a transom means adjacent the aft portion thereof for receiving outboard engines of conventional design.

4. The water vehicle of claim 1 further comprised of a pair of outrigger means for providing additional flotation to said vehicle, said outrigger means beind disposed on each side of the aft portion of said vehicle and connected to said hull member, the lower surface of said outrigger means each defining a planing surface.

5. The water vehicle of claim 4 wherein said outrigger means are connected to and spaced apart from said hull member by wing-like members having the lower aft portion thereof joining said hull member adjacent the bottom of said hull member, and having a forward edge joining said hull member at an upper region of said hull member so as to be normally disposed above the surface of the water when the vehicle is at rest and when traveling at low speeds, said forward edge and said lower aft portion being separated by the lower surfaces of said wing-like members thereby defining planing surfaces.

6. The water vehicle of claim 5 wherein said winglike members have a substantially swept-back planform.

7. The water vehicle of claim 6 wherein the lower surface of said outrigger means is a lateral continuation of the contour of said lower surface of said wing-like members.

8. The water vehicle of claim 5 wherein said hydrofoil means comprises a hydrofoil support member projecting downward from the lower surface of each of said outrigger means, with a hydrofoil adjacent the lower end of each of said hydrofoil support members.

9. The water vehicle of claim 8 wherein each of said hydrofoil support members is inclined in a forward direction.

10. The water vehicle of claim 8 wherein each of said hydrofoil means is further comprised of an additional hydrodynamic support member above the respective said hydrofoil, each of said additional members being attached to and supported by the respective one of said hydrofoil support members at approximately the same elevation as the bottom surface of said hull member.

11. A water vehicle comprising:

an elongated hull member having a bow section, a stern section and a central section therebetween, said stern section having a transom at the aft end therof for receiving an outboard engine, said central section having a seat on the top surface thereof, said bow section being wider than said central section and having a lower surface defining a planing surface for supporting the bow section at high speeds, said bow section joining said central section so as to provide foot rests for an operator, handlebar means on the forward portion of said hull member, said handlebar means including means coupleable to an outboard engine mounted on said transon so as to rotate said engine in a direction generally opposite the rotation of said handlebar means, said handlebar means further including throttle control means coupleable to the throttle control of an outboard engine for controlling the power setting of said engine in response to the rotation of one of the hand grips on said handlebar means, a pair of outrigger means for providing flotation to said vehicle, said outrigger means being disposed on each side of the aft portion of said vehicle and connected to said hull member, said outrigger means each having lower surfaces defining planing surfaces; and support means for engaging the water and for providing a support force aft of the center of gravity of the vehicle when said vehicle is propelled at a suitably high speed so as to support said stern section above the surface of the water, said planing surface on said bow section comprising the primary vehicle support forward of the center of gravity of said vehicle when said stern section is being support above the surface of the water.

12. The water vehicle of claim 11 wherein said support means comprises a water ski-like member disposed on each side of and below the lower surface of said hull member.

13. The water vehicle of claim 11 wherein said support means comprises hydrofoil means disposed on each side of said hull member.

14. The water vehicle of claim 11 wherein said support means comprises a forward and downward projecting hydrofoil support member at each side of the aft portion of said hull member and including hydrofoil means adjacent the bottom thereof.

15. The water vehicle of claim 11 wherein said support means comprises a forward and downward projecting hydrofoil support member at each side of the aft portion of said hull member, each of said hydrofoil support members having a hydrofoil means adjacent the bottom thereof.

16. The water vehicle of claim 15, wherein said support means are positioned with respect to the center of gravity of said vehicle so as to support not less than 60 percent nor more than 85 percent of the weight of said vehicle at high speed.

17. The water vehicle of claim 11 wherein each of said outrigger means is connected to and spaced apart from said hull member by wing-like members having the lower aft portion thereof joining said hull member adjacent the bottom of said hull member and having a forward edge joining said hull member at an upper region thereof so as to be normally disposed above the surface of the water when the vehicle is at rest and when moving at low speed, said forward edge and said lower aft portion being separated by the lower surface of said wing-like members defining a planing surface.

18. A water vehicle comprising:

a hull member having a bow section, a stern section and a central section therebetween, said central section having a means for accommodating at least one passenger, said bow section having a lower surface defining a planing surface, said planing surface giving the primary support to said bow section when said vehicle is traveling at a substantial speed;

a pair of flotation means for providing flotation to said vehicle, said flotation means being disposed on each side of the aft portion of said vehicle and connected to said hull member, the lower surface of each of said flotation means defining a planing surface; and support means for engaging the water and for providing a support force aft of the center of gravity of the vehicle when said vehicle is propelled at a suitably high speed so as to support said stern section and said flotation means above the surface of the water.

19. The water vehicle of claim 18 wherein said stern section of said hull member includes a transom for receiving at least one outboard engine of conventional design.

20. The water vehicle of claim 19 further comprised of steering means including means coupleable to an outboard engine mounted on said transom for rotating said engine in response to said steering means.

21. The water vehicle of claim 18 wherein said support means and said planing surface are disposed with respect to the center of gravity of said vehicle so that said support means will support between 60 and 85 percent of the weight of said vehicle when propelled at a suitably high speed.

22. The water vehicle of claim 18 further comprised of a pair of sliding members and a control means, each of said sliding members being slideably attached to the lower aft surface of one of said flotation means and slidable so as to effectively extend the lower surface of the respective flotation means, said control means being a means for controlling the position of said sliding members.

23. The water vehicle of claim 18 further comprised of a pair of rotatable generally flat members and a control means, each of said members being rotationally affixed adjacent the lower aft portion of said flotation means, said control means being a means for controlling the angular position of said rotatable members.

24. The water vehicle of claim 18 further comprised of a pair of rotatable, generally flat members and a control means, each of said rotatable members being rotationally affixed adjacent to said planing surface with said rotatable members being generally symmetrically located on each side of the center of said vehicle, said rotatable members having their axis of rotation inclined with respect to the center of said vehicle so as to cross at a position aft of said rotatable members, said control means being a means of controlling the angular position of said control members.

25. The water vehicle of claim 24 wherein said control means is a means of providing individual control of said rotatable members.

26. A water vehicle comprising:

an elongated hull member having a bow section, a stern section and a central section therebetween, said stern section having a transom at the aft end thereof for receiving an outboard engine, said central section having a seat on the top surface thereof, said bow section being wider than said central section and having a lower surface defining a planing surface, said planing surface being the primary support for said bow section at high speeds, said bow section joining said central section so as to provide foot rests for an operator;

handlebar means on the forward portion of said hull member, said handlebar means including means coupleable to an outboard engine mounted on said transom so as to rotate said engine in a direction generally opposite the rotation of said handlebar means, said handlebar means further including throttle control means coupleable to the throttle control of an outboard engine for controlling the power setting of said engine in response to the rotation of one of the hand grips on said handlebar means;

a pair of outrigger means for providing flotation to said vehicle, said outrigger means being disposed on each side of the aft portion of said vehicle and connected to said hull member, said outrigger means having lower surfaces defining planing surfaces, said outrigger means being connected to and spaced apart from said hull member by wing-like members having the lower aft portion thereof joining said hull member adjacent the bottom of said hull member at an upper region thereof so as to be normally disposed above the surface of the water when the vehicle is at rest and when traveling at low speeds, said forward edge and said lower aft portion being separated by the lower surfaces of said wing-like members thereby defining planing surfaces;

said wing-like members having a substantially swept-back planform;

the lower surface of said outrigger means being a lateral continuation of the contour of sid lower surface of said wing-like members; and support means for engaging the water and for providing a support force aft of the center of gravity of the vehicle, said support means having a hydrofoil support member projecting downward and forward from the lower surface of each of said outrigger means, with a hydrofoil adjacent the lower end of each of said hydrofoil support members, said bow planing surface providing stability for said hydrofoil means about the pitch axis when said vehicle is moving at substantial speed.

* * * * *